US008865058B2

(12) United States Patent
Seals et al.

(10) Patent No.: US 8,865,058 B2
(45) Date of Patent: Oct. 21, 2014

(54) HEAT TREATMENT FURNACE

(75) Inventors: Roland D. Seals, Oak Ridge, TN (US); Jeffrey G. Parrott, Clinton, TN (US); Paul D. DeMint, Kingston, TN (US); Kevin R. Finney, Knoxville, TN (US); Charles T. Blue, Knoxville, TN (US)

(73) Assignee: Consolidated Nuclear Security, LLC, Reston, VA (US)

( * ) Notice: Subject to any disclaimer, the term of this patent is extended or adjusted under 35 U.S.C. 154(b) by 260 days.

(21) Appl. No.: 13/086,840

(22) Filed: Apr. 14, 2011

(65) Prior Publication Data

US 2011/0254208 A1 Oct. 20, 2011

Related U.S. Application Data

(60) Provisional application No. 61/323,986, filed on Apr. 14, 2010.

(51) Int. Cl.

| | |
|---|---|
| ***C21D 9/00*** | (2006.01) |
| ***F27B 9/06*** | (2006.01) |
| ***F27B 9/04*** | (2006.01) |
| ***F27D 11/12*** | (2006.01) |
| ***F27D 7/06*** | (2006.01) |
| ***F27D 99/00*** | (2010.01) |
| ***F27B 9/02*** | (2006.01) |

(52) U.S. Cl.

CPC ..... *F27B 9/063* (2013.01); *F27B 9/045* (2013.01); *F27D 11/12* (2013.01); *F27D 7/06* (2013.01); *F27D 99/0006* (2013.01); *F27B 9/066* (2013.01); *F27B 9/028* (2013.01)

USPC ..... 266/241; 266/249

(58) Field of Classification Search

USPC ..... 266/249, 241, 103

See application file for complete search history.

(56) References Cited

U.S. PATENT DOCUMENTS

| | | | |
|---|---|---|---|
| 15,001 | A | 12/1920 | Costello |
| 3,806,312 | A | 4/1974 | McMaster et al. |

(Continued)

FOREIGN PATENT DOCUMENTS

| | | |
|---|---|---|
| EP | 0061158 A1 | 9/1982 |
| EP | 0113919 | 7/1984 |

(Continued)

OTHER PUBLICATIONS

European Patent Office, Notification of Transmittal of the International Search Report and the Written Opinion of the International Searching Authority, or the Declaration, Date of Mailing: Aug. 17, 2011 PCT/US2011/032507.

(Continued)

*Primary Examiner* — Scott Kastler

(74) *Attorney, Agent, or Firm* — Michael J. Renner, Esq.; Luedeka Neely Group, P.C.

(57) ABSTRACT

A furnace heats through both infrared radiation and convective air utilizing an infrared/purge gas design that enables improved temperature control to enable more uniform treatment of workpieces. The furnace utilizes lamps, the electrical end connections of which are located in an enclosure outside the furnace chamber, with the lamps extending into the furnace chamber through openings in the wall of the chamber. The enclosure is purged with gas, which gas flows from the enclosure into the furnace chamber via the openings in the wall of the chamber so that the gas flows above and around the lamps and is heated to form a convective mechanism in heating parts.

21 Claims, 7 Drawing Sheets

(56) References Cited

U.S. PATENT DOCUMENTS

| | | | | |
|---|---|---|---|---|
| 4,229,236 | A | 10/1980 | Heath | |
| 4,460,821 | A | 7/1984 | Crain et al. | |
| 4,477,718 | A | 10/1984 | Crain et al. | |
| 4,517,448 | A | 5/1985 | Crain et al. | |
| 4,620,884 | A | 11/1986 | Heath | |
| 4,694,180 | A | 9/1987 | Salisbury et al. | |
| 4,914,276 | A | 4/1990 | Blair | |
| 5,007,826 | A | 4/1991 | Wiinning | |
| 5,035,066 | A | 7/1991 | Wimberger | |
| 5,108,520 | A | 4/1992 | Liu et al. | |
| 5,223,453 | A | 6/1993 | Sopori | |
| 5,279,534 | A | 1/1994 | Burlion et al. | |
| 5,306,359 | A | 4/1994 | Eppeland et al. | |
| 5,340,089 | A | 8/1994 | Heath et al. | |
| 5,340,418 | A | 8/1994 | Wei | |
| 5,372,781 | A | 12/1994 | Hallett et al. | |
| 5,485,985 | A | 1/1996 | Eppeland et al. | |
| 5,551,670 | A | 9/1996 | Heath et al. | |
| 5,864,119 | A | 1/1999 | Vogt et al. | |
| 5,981,919 | A | 11/1999 | Masten, Jr. | |
| 6,018,144 | A | 1/2000 | Vogt et al. | |
| 6,114,664 | A | 9/2000 | Cook et al. | |
| 6,135,344 | A | 10/2000 | Sakuyama et al. | |
| 6,174,388 | B1 | 1/2001 | Sikka et al. | |
| 6,217,317 | B1 | 4/2001 | Crafton et al. | |
| 6,288,366 | B1 | 9/2001 | Dings | |
| 6,503,078 | B1 | 1/2003 | Hirano | |
| 6,623,269 | B2 | 9/2003 | Tsutsui et al. | |
| 6,667,111 | B2 | 12/2003 | Sikka et al. | |
| 6,683,281 | B2 | 1/2004 | Sundberg et al. | |
| 6,901,990 | B2 | 6/2005 | Howard et al. | |
| 6,972,058 | B1 | 12/2005 | Underys | |
| 7,094,993 | B2 | 8/2006 | Richert et al. | |
| 7,170,036 | B2 | 1/2007 | Richert et al. | |
| 7,258,755 | B2 | 8/2007 | Crafton et al. | |
| 7,338,629 | B2 | 3/2008 | Crafton et al. | |
| 7,514,650 | B2 | 4/2009 | Melgaard et al. | |
| 8,197,907 | B2 * | 6/2012 | Dibon et al. | 427/444 |
| 2001/0031229 | A1 | 10/2001 | Spjut et al. | |
| 2002/0104596 | A1 | 8/2002 | Crafton et al. | |
| 2007/0122936 | A1 | 5/2007 | Park et al. | |
| 2008/0099459 | A1 | 5/2008 | Williams | |
| 2008/0236779 | A1 | 10/2008 | Crafton et al. | |
| 2011/0254208 | A1 * | 10/2011 | Seals et al. | 266/249 |

FOREIGN PATENT DOCUMENTS

| | | | |
|---|---|---|---|
| EP | 1010960 | A1 | 6/2000 |
| WO | 8703077 | | 5/1987 |
| WO | 2007067216 | A2 | 6/2007 |
| WO | 2007067216 | A3 | 6/2007 |

OTHER PUBLICATIONS

Patent Abstract of Japan, Publication No. 03-152387, date of publication Jun. 28, 1991 (1 page) Akagi Hirokazu et al. Drying/Heating Furnace Using Both Convection and Radiation Heating.

Leisure Heating—The Infra-red Heating Specialists Short-Wave Infra-red Industrial Heating (1 page) date Apr. 7, 2009.

Heraeus Noblelight, Heating with Infrared, dated Apr. 7, 2009 (1 page).

Infrared Heating Technologies, LLC , Infrared Heating Applications, dated May 15, 2008, (9 pages).

Queen City Forging, Co., Aluminum-Hot-Forging.com, dated Apr. 7, 2009 (4 pages).

* cited by examiner

HEAT TREATMENT FURNACE

CROSS-REFERENCE TO RELATED APPLICATION

This application claims priority to U.S. Provisional Application Ser. No. 61/323,986 filed Apr. 14, 2010, and entitled HEAT TREATMENT FURNACE, incorporated by reference herein in its entirety.

GOVERNMENT RIGHTS

The U.S. Government has rights to this invention pursuant to contract number DE-AC05-00OR22800 between the U.S. Department of Energy and Babcock & Wilcox Technical Services Y-12, LLC.

FIELD

This disclosure relates to the field of furnaces for heat treating workpieces, such as cast workpieces of metals and metal alloys. More particularly, this disclosure relates to a furnace and furnace system that accomplishes heat treatment using radiant heat from infrared heating devices, with the heating devices being cooled by introduction of a cooling gas and the gas being thereafter routed into the furnace to provide convective heating.

BACKGROUND

Conventional heat treatment furnaces do not enable sufficiently precise control over the heat treatment of workpieces. Additionally, conventional furnaces are relatively large and not compatible with in-line manufacturing processes. They are incompatible because conventional treatment processes utilize only one centralized furnace for all heat treatment operations, despite the fact that there are typically several heat treatment operations involved in a manufacturing process. Thus, substantial manufacturing delays and bottlenecks arise due to the time and logistics of transporting parts to the furnace and associated treatment times.

Accordingly, improvement is desired in regards to furnaces and heat treatment processes for heat treatment of workpieces.

SUMMARY

The above and other needs are met by a heat treatment furnace for heat treating a workpiece.

In one embodiment, the furnace includes a treatment chamber into which the workpiece is introduced for treatment; an electrically powered source of infrared radiation located within the chamber, the source having an electrical connection; an enclosure within which the electrical connection is located and substantially isolated from the treatment chamber; a source of a first flowing gas in flow communication with the enclosure to flow gas past the electrical connection to cool the electrical connection, the first flowing gas being heated as it flows past the electrical connection; and a passage from the enclosure to the treatment chamber to exit the thus heated first flowing gas from the enclosure to the treatment chamber.

The furnace may also include rollers provided as by low heat capacity metal tubes or pipes located within the furnace and rotatably mounted to the furnace sidewalls, preferably using ceramic bearings. The structure and mounting of the rollers keeps them from overheating and warping, and avoids any need to cool the rollers.

The furnace also may include a pre-treatment chamber, a post-treatment chamber, or both, to provide desired pre-treatment and post-treatment temperature conditions as may be desired.

In another aspect, the disclosure provides a system for heat treating a workpiece, having a first treatment station for treating the workpiece and a second treatment station for treating the workpiece subsequent to its treatment at the first treatment station. The first treatment station and the second treatment station are in-line with one another and utilize furnaces as described above. This system advantageously enables the use of furnaces for each treatment step configured to provide optimum conditions, and arranged to enable treatment of workpieces in a more efficient manner as compared to conventional treatment processes.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

The disclosure relates to furnace systems and processes for the heat treatment of metals, metal alloys, and other materials. Heat treatment furnaces according to the disclosure enable significant enhancements compared to conventional furnaces to provide repeatable performance so as to yield improvements in the quality of the heat treated materials.

Figure 1:
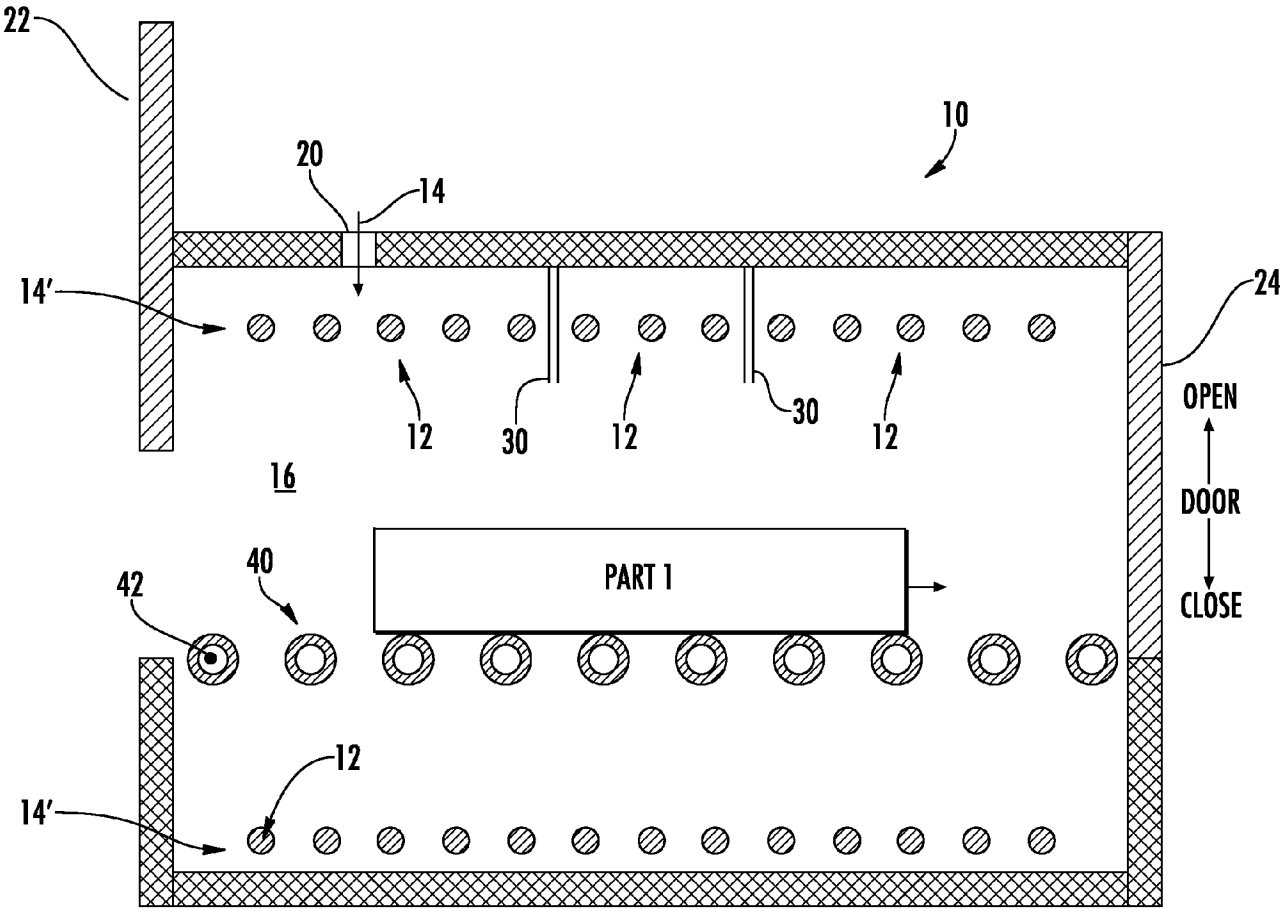
FIG. 1 is a schematic view of a furnace according to the disclosure.

In one aspect, and with reference to FIG. 1, a furnace 10 according to the disclosure heats through both infrared radiation and convective air by incorporation of an infrared (IR)/purge gas system that enables improved temperature control. In this regard, the furnace 10 includes a plurality of infrared radiation sources 12 and a source of flowing gas 14.

The furnace 10 may be of various configurations to provide a primary treatment chamber 16 of a desired shape, such as a square cube chamber, a rectangular chamber, or a cylindrical chamber. In any of these cases, it is preferable to orient the infrared radiation sources 12 in a horizontal position. The furnace 10 may include the sources 12 along all four sides of a rectangular chamber, or along the top and bottom sides, or along the left and right sides, or along just one side or any three sides, or along the circumference of a cylindrical shape. It is preferable to orient the infrared radiation sources 12 in a horizontal position, with the sources aligned across the top and bottom sides, along the axis of any chamber for the left and right sides or along the axis of the cylindrical shaped chamber.

In one example, preferred infrared radiation sources 12 may include T3 tungsten halogen lamps having a power rating of 3.65 kilowatts per lamp, with the number of lamps conforming to the desired total power output and the lamps desirably spaced at approximately 1-inch centers. The use of T3 tungsten halogen lamps as the infrared radiation sources 12 advantageously enables rapid heating/cooling to provide the desired temperatures/heating times. For an in-line furnace, the number of infrared radiation sources, such as the lamps, may be increased to increase the length of the hot zone of the chamber 16 to accomplish the desired throughput, with the lamps spaced at approximately 1-inch centers, such as shown for the furnace 10' of FIG. 3.

Accordingly, for the purpose of example, a furnace designed with a 15-ft hot zone would preferably have approximately 180 lamps per side and, thus, 360 lamps in a two-sided configuration to yield a total power output of about 1314 kilowatts. The furnace 10' of increased length enables treatment of additional workpieces, such as Part 2 and Part 3. The heating desirably accomplished in the preliminary treatment chamber 16 is a treatment in which a workpiece is heated to a suitable temperature and held at this temperature for a sufficient length of time to allow a desired constituent to enter into solid solution, followed by rapid cooling to hold the constituent in solution.

Figure 2A:
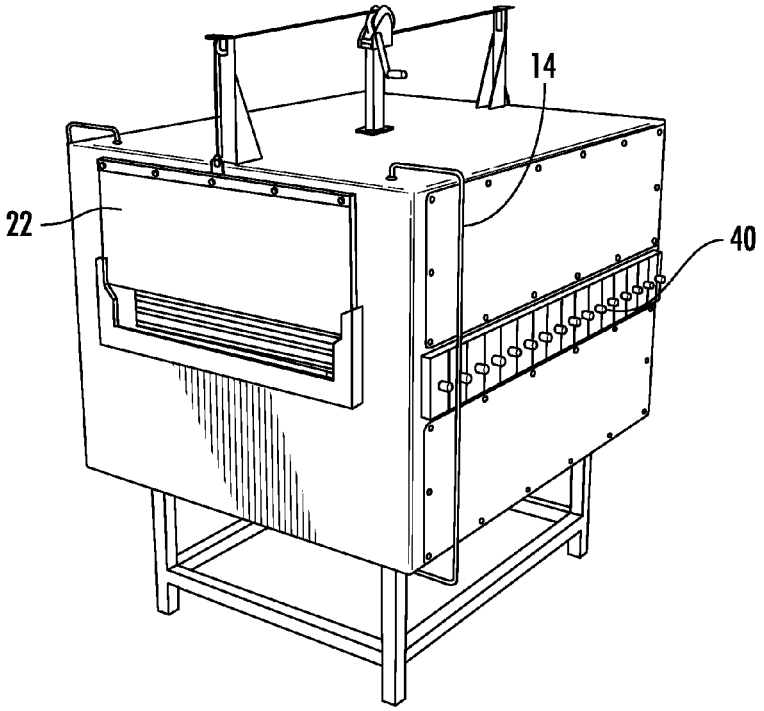
FIG. 2*a* is a right side perspective view of a furnace according to the disclosure.
Figure 2B:
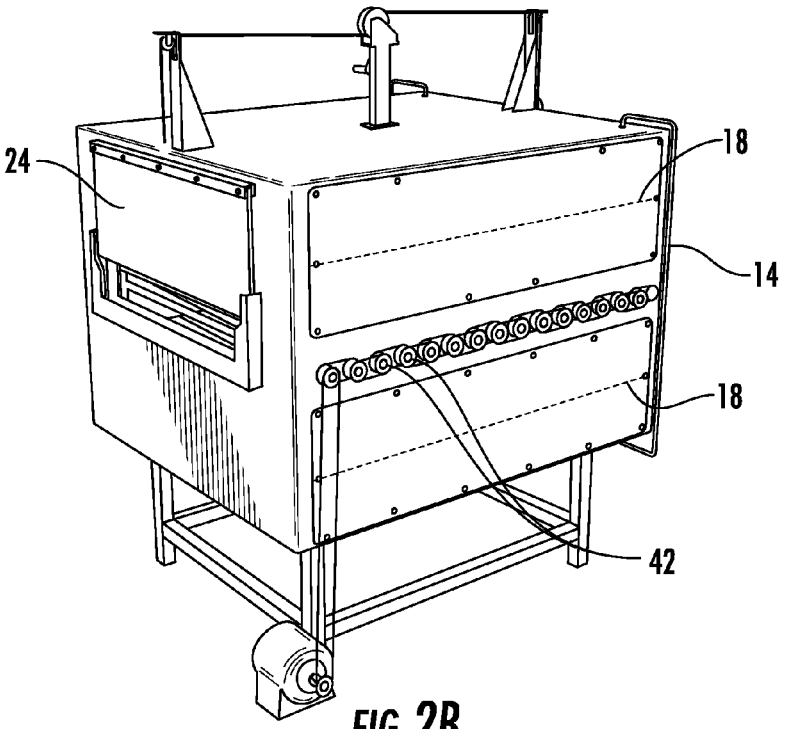
FIG. 2*b* is a left side perspective view of the furnace of FIG. 2*a*.
Figure 2C:
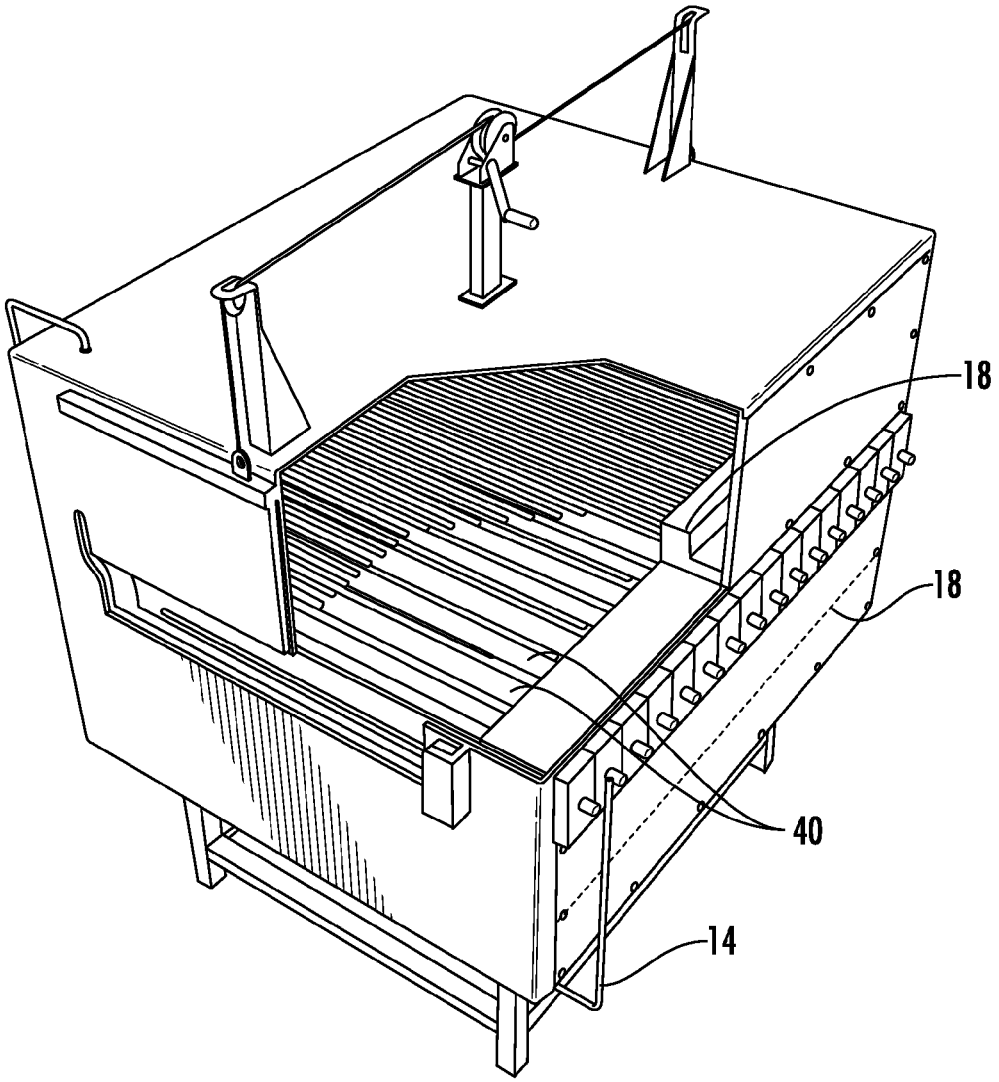
FIG. 2*c* is a cut-away view of the furnace of FIG. 2*a*.

The sources of infrared radiation 12, such as the tungsten halogen lamps, include electrical end connections that are located within an enclosure 18, one per end of the sources 12, (FIG. 2*c*) or otherwise isolated from the treatment chamber 16, with the lamps extending into the furnace chamber through openings in the enclosures 18 or other isolating structure. The flowing gas 14 is routed into the enclosures 18 and the enclosures 18 are purged with the flowing gas 14 so that the gas flows past the electrical end connections of the sources 12 for cooling thereof and temperature maintenance of the sources 12.

The gas 14 exits the enclosures 18 into the chamber 16 via openings 20 in the enclosures 18 and is introduced so that the gas flows from the side of the sources 12 away from the chamber (e.g., above, below, beside) and around the sources 12 and is heated to form a convective mechanism in heating workpieces or parts, such as Part 1, treated by the furnace 10. As discussed in more detail below, depending on the nature of the workpieces to be treated and the treatment to be accomplished, the gas 14 may be air or, in some cases, it is preferred to be an inert gas, such as argon. It will be understood that when an inert gas is used, the enclosure 18 is constructed to be sealed so as to not permit air from the atmosphere to enter.

A secondary flow of a gas, as indicated by arrows 14' (FIG. 1), may be provided into the chamber 16, without first passing over the electrical end connections of the sources 12, to decrease the time to accomplish chamber purge. The secondary flow of gas is desirably introduced to flow over the sources 12 to allow reheating of the gas and prevent convective cooling of the parts being treated. Likewise, the secondary flow of gas may be air or an inert gas, depending on the nature of the workpieces to be treated and the treatment to be accomplished.

Doors 22 and 24 are located at the opposite ends of the furnace to enclose the furnace for limiting thermal losses and control of the treatment process. The doors 22 and 24 are selectively operable for desirably opening and closing as needed to permit ingress and egress of the parts to be treated.

It has been observed that the structure of the furnace systems according to the disclosure and utilization of the flowing gas 14 (and 14') as described in combination with the infrared radiation sources enables improved temperature control such that the furnace temperature may be controlled within +/−5° C. and provides uniform furnace and part thermal profiles yielding repeatable heat treatment cycles from part to part/batch to batch. It is believed that introduction of gas into the furnace in a manner that achieves turbulent flow provides additional advantages and uniform heating.

The use of T3 tungsten lamps as the source of infrared radiation sources 12 has been observed to enable rapid heating/cooling to provide the desired temperatures/heating times. For the purpose of example, it has been observed that the lamp ends may be maintained at a temperature of below about 650° F. (~343° C.) by the flowing gas 14 being a flow of argon gas (70 cfh or 15-20 cfm) over the lamp end connections. With this, the secondary flow of gas 14' is preferably provided at a flow rate of about 10 cfm. It will be understood that the flow rates and nature of the gas may be changed to provide desired conditions. For example, as discussed below, the gases may be air or, in some circumstances it is desirable to use an inert gas, such as argon. Also, it will be appreciated that heating to temperatures of above 100° C. also serves to help remove adsorbed oxygen and moisture.

Figure 3:
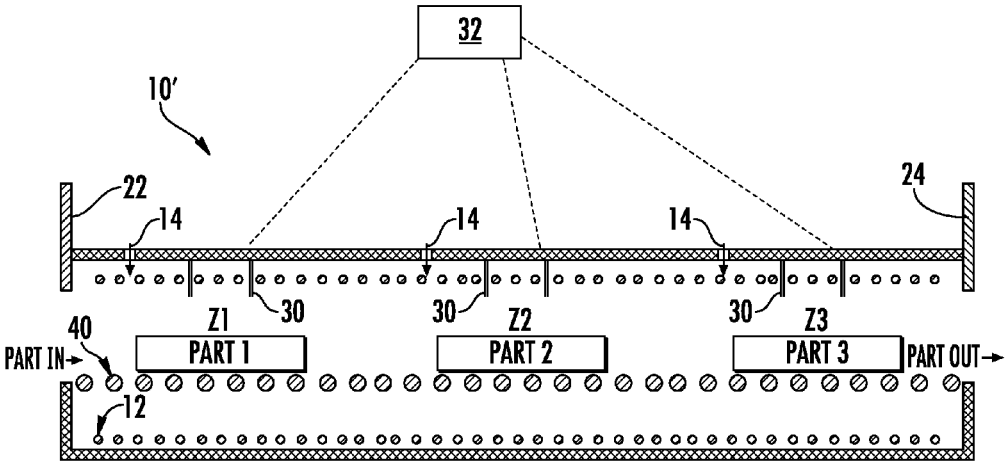
FIG. 3 depicts in-line heat treatment of a plurality of parts in accordance with the disclosure.

The furnace systems according to the disclosure may also include one or more furnace control thermocouples 30 located in the chamber 16. The thermocouples 30 may be suspended from the furnace top to measure the chamber environment temperature, such as between the top and bottom sets of the infrared radiation sources 12. Suitable devices for providing the thermocouples include K-type stainless steel sheath thermocouples. The thermocouples 30 are coupled to a computer controller 32 (FIG. 3) for controlling operation of the infrared radiation sources 12 to provide the desired heating. If desired, various zones may be provided between each set of thermocouples if it is desired to provide different heating of a part over time, such as shown in FIG. 3. That is, a plurality of zones (Z1, Z2, and Z3) may each have the same or different thermal properties, such that as a part enters, it is treated according to the properties of zone Z1, thereafter according to the properties of zone Z2, and then zone Z3, as controlled by use of the control system associated with the thermocouples 30 of each of the zones.

Another aspect of the furnace systems according to the disclosure relates to the provision of low heat capacity tubular rollers 40 located within the furnace and rotatably mounted to the furnace sidewalls using ceramic bearings 42. The ceramic bearings 42 do not require insulation, the roller design does not require or have any active cooling (no cooling fluid), and the roller design is subject to the furnace conditions. It has been observed that the structure and mounting of the rollers 40 keeps them from overheating and warping, and avoids any need to cool the rollers 40. The rollers 40 may be provided as by low heat capacity metal tubes or pipes.

As mentioned above, the gases may be air or an inert gas, depending on the nature of the workpieces to be treated and the treatment to be accomplished. For example, the gases can be air if the parts being heated are not oxygen or moisture sensitive; otherwise, the gases are desirably an inert gas such as argon. In such cases, where the workpieces are not oxygen or moisture sensitive, it will be understood that the enclosures 18 do not need to be constructed so as to wholly isolate the flow of gas 14 from entry of oxygen and moisture, such as from the external environment.

The gases can also be used to control the atmosphere for the treatment process. For example, a controlled atmosphere may help to reduce the effects of oxidization or to provide an enriching atmosphere for surface chemistry effects on the part being treated. In some cases, a reducing atmosphere is required and can, for example, be accomplished by the use of hydrogen in the purge gas, such as 96% Ar-4% H2. Also, heat treatment of silicon wafers, low-k thin films of SiO2, treatments of ceramics for strengthening, surface treatments of silicon wafers, solar panels, and photovoltaic materials require hydrogen in the process purge gas.

Figure 4:
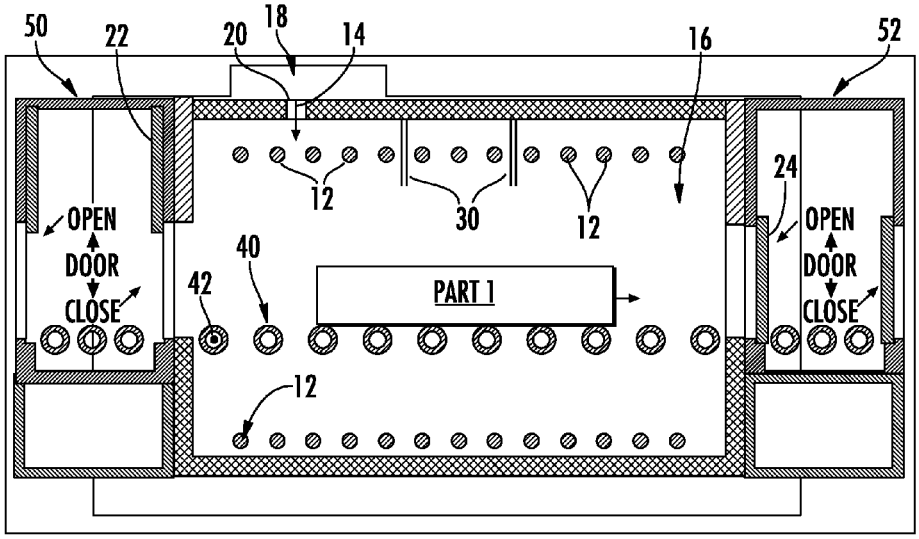
FIG. 4 depicts a furnace according to the disclosure having pre-treatment and post-treatment locations.

Furnaces according to the disclosure may also include a pre-treatment chamber 50, or a post-treatment chamber 52, or both (FIG. 4). The inclusion of pre-treatment or post-treatment chambers is particularly desirable when an inert gas is utilized. For example, with the use of the pre-treatment chamber 50 and/or the post-treatment chamber 52, the inert gas in the treatment chamber 16 is maintained and not lost, and the treatment chamber 16 is not exposed to air, oxygen, moisture and the like. This is useful to reduce purging times and improve throughput times and improve the quality of the treatment and hence the quality of the treated parts.

Figure 5:
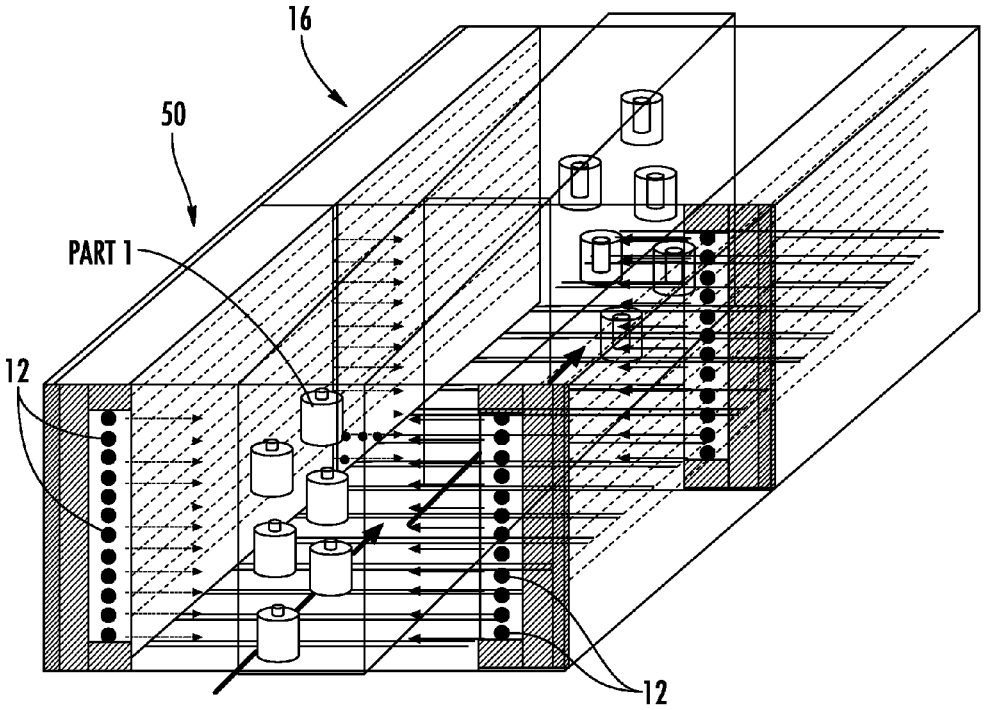
FIG. 5 depicts a furnace according to the disclosure having right and left side heating with a pre-treatment section.
Figure 6:
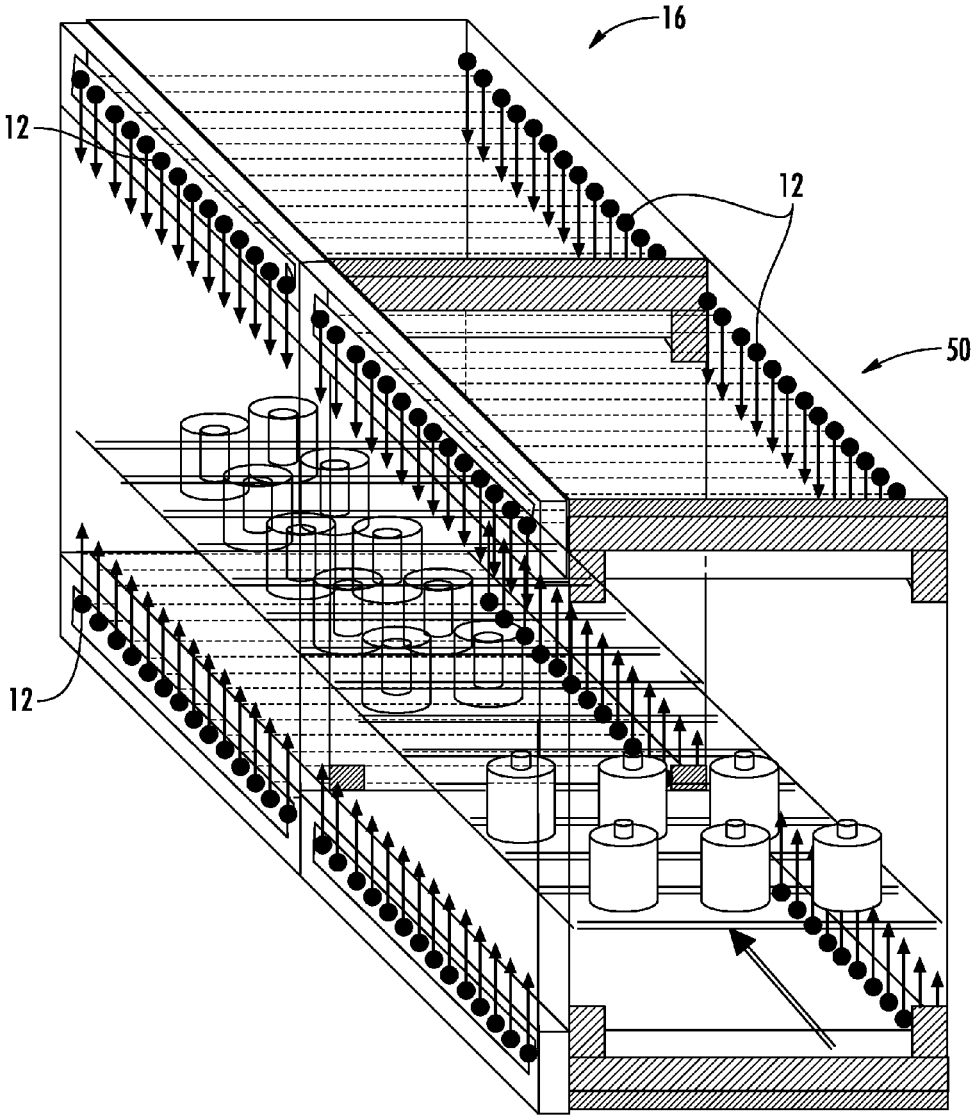
FIG. 6 depicts a furnace according to the disclosure having top and bottom heating with a pre-treatment section.

In this regard, the pre-treatment chamber 50 and the post-treatment chamber 52 may be configured in a manner similar to that described for the chamber 16, to provide desired heat treatment in advance of entering, or after leaving the primary treatment chamber 16. For example, the pre-treatment chamber 50 enables equilibration of workpieces which have cooled to different temperatures in a prior stage or step, such as a casting stage. That is, the pre-treatment chamber 50 may be used to pre-heat the workpiece to a desired starting temperature prior to its entry into the treatment chamber 16. FIG. 5 shows a furnace having right and left side heating with a pre-treatment section. FIG. 6 shows a furnace having top and bottom heating with a pre-treatment section.

The pre-treatment chamber 50 may be utilized, for example, for removal of cores from cast parts in advance of the heat treatment in the chamber 16. The pre-treatment chamber 50 provides heating to oxidize, vaporize, or melt various components of a core with collection and control equipment integrated into the furnace. The collection equipment can be designed to collect the core solids for disposal and/or collect any vapors or sublimed materials. The collection equipment may include trays or other collection devices, and vapors may be collected as by vacuuming. For example, cores are made of silica/sand held in place by a polymer to form the core. Cores are conventionally removed by mechanical removal, wherein the cast parts are cooled so as to be able to be handled by an operator, and then the cores are hit or otherwise mechanically removed by breaking them.

In contrast to conventional core removal, the use of a furnace having a pre-treatment chamber according to the disclosure enables the workpiece, i.e., a cast part, to be heated to a temperature below the treatment temperature but sufficiently high to fluidize the polymer of the core such that the core essentially flows from the workpiece and the core materials are easily separated from the workpiece and recovered. In a similar manner, the post-treatment chamber may be configured to provide desired post-treatment temperature conditions as may be desired.

Another aspect of the furnace systems according to the disclosure relates to the compact and flexible design of furnaces according to the disclosure, which is believed to enable significant advantages to the heat treatment of workpieces. For example, conventional furnaces are relatively large and not compatible with in-line manufacturing processes. They are incompatible because conventional treatment processes utilize only one centralized furnace for all heat treatment operations, despite the fact that there are typically several heat treatment operations involved in a manufacturing process. Thus, substantial manufacturing delays and bottlenecks arise due to the time and logistics of transporting parts to the furnace and associated treatment times.

Figure 7:
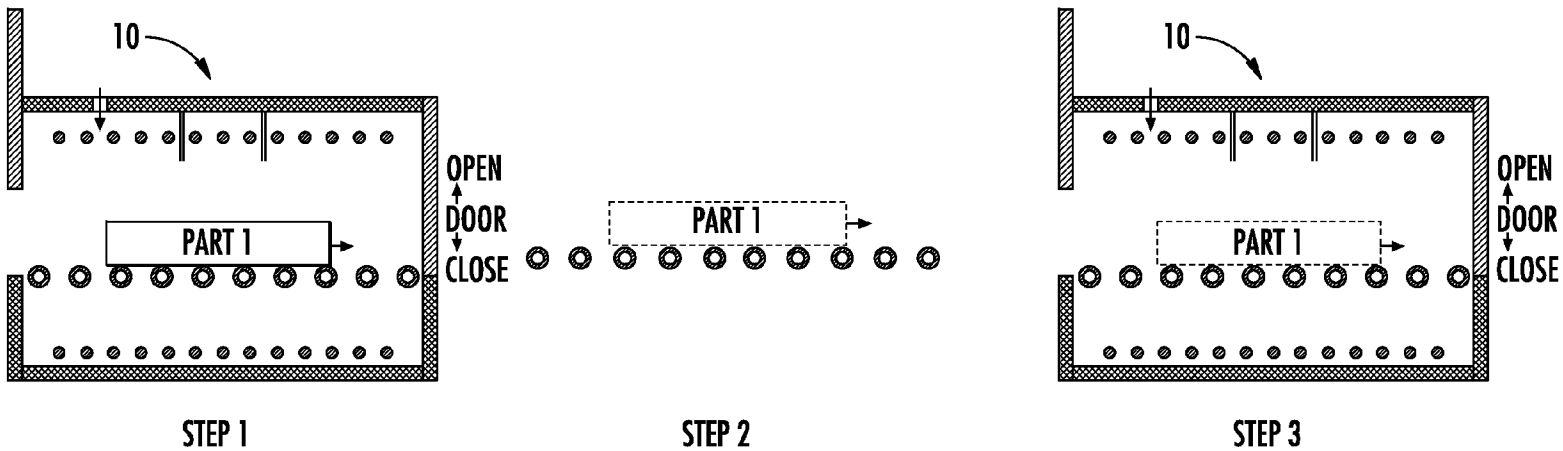
FIG. 7 depicts an in-line treatment process according to the disclosure.

Furnaces according to the disclosure may be constructed to be compact units that can be placed in-line at desired locations of the process. The basic layout of each furnace may be substantially the same, but with small changes in the length and layout or amount of infrared radiation sources to account for temperature and time requirements for a particular heat treatment step. That is, a treatment process may be configured so that a plurality of the furnaces according to the disclosure are incorporated into the process, such as shown in FIG. 7.

A process which incorporates furnaces of the disclosure facilitates the provision of a continuous, in-line process for treating workpieces in an assembly line style. For example, as shown in FIG. 7, as a workpiece, such as Part 1, travels from Step 1 to Step 2, to Step 3, an individual furnace is provided at each step that requires heat treatment. In this regard, it will be appreciated that the furnace for a given step can therefore be customized to provide optimum conditions for the desired treatment at a step. As will be appreciated, this is advantageous in comparison to conventional processes that utilize a central furnace and require transportation of parts from various steps in the treatment process to the central furnace, which therefore must be operated at a variety of operating conditions. Such a conventional furnace having to be used for a variety of different uses will typically perform satisfactorily for most needs, but will not ever provide optimum conditions.

The furnace design of the disclosure therefore enables an in-line manufacturing process that incorporates furnaces in a manner that preserves a substantially continuous manufacturing operation and provides improved operating conditions as compared to conventional processes.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A heat treatment furnace for heat treating a workpiece, the furnace comprising:

a treatment chamber into which the workpiece is introduced for heat treatment;

an electrically powered source of infrared radiation for heat treatment located within the chamber, the infrared radiation source having an electrical connection;

an enclosure within which the electrical connection is located and substantially isolated from the treatment chamber while the remainder of the infrared radiation source extends into the treatment chamber;

a source of a first flowing gas in flow communication with the enclosure to flow gas past the electrical connection to cool the electrical connection, the first flowing gas being heated as it flows past the electrical connection; and a passage from the enclosure to the treatment chamber to exit the thus heated first flowing gas from the enclosure to the treatment chamber.

2. The furnace of claim 1, wherein the passage is located to pass the exiting first flowing gas proximate portions of the source of infrared radiation within the treatment chamber for further heating of the first flowing gas as it enters the treatment chamber.

3. The furnace of claim 1, wherein the source of infrared radiation is a lamp and the electrical connection is an end connection of the lamp.

4. The furnace of claim 1, further comprising a source of a second flowing gas in flow communication with the treatment chamber.

5. The furnace of claim 1, further comprising a separate pre-treatment chamber for heat treating the workpiece prior to its introduction into the treatment chamber.

6. The furnace of claim 5, further comprising a separate post-treatment chamber for heat treating the workpiece after its exit from the treatment chamber.

7. The furnace of claim 1, further comprising a separate post-treatment chamber for heat treating the workpiece after its exit from the treatment chamber.

8. A system for heat treating a workpiece, the system comprising:

a first treatment station for heat treating the workpiece and a second treatment station for heat treating the workpiece subsequent to its treatment at the first treatment station, the first treatment station and the second treatment station being in-line with one another and each comprising:

a treatment chamber into which the workpiece is introduced for heat treatment; an electrically powered source of infrared radiation for heat treatment located within the chamber, the infrared radiation source having an electrical connection; an enclosure within which the electrical connection is located and substantially isolated from the treatment chamber while the remainder of the infrared radiation source extends into the treatment chamber;

a source of a first flowing gas in flow communication with the enclosure to flow gas past the electrical connection to cool the electrical connection, the first flowing gas being heated as it flows past the electrical connection; and a passage from the enclosure to the treatment chamber to exit the thus heated first flowing gas from the enclosure to the treatment chamber.

9. The system of claim 8, wherein the passage is located to pass the exiting first flowing gas proximate portions of the source of infrared radiation within the treatment chamber for further heating of the first flowing gas as it enters the treatment chamber.

10. The system of claim 8, wherein the source of infrared radiation is a lamp and the electrical connection is an end connection of the lamp.

11. The system of claim 8, further comprising a source of a second flowing gas in flow communication with at least one of the treatment chambers.

12. The system of claim 8, further comprising a separate pre-treatment chamber for heat treating the workpiece prior to its introduction into one of the treatment chambers of the treatment stations.

13. The system of claim 12, further comprising a separate post-treatment chamber for heat treating the workpiece after its exit from one of the treatment chambers of the treatment stations.

14. The system of claim 8, further comprising a separate post-treatment chamber for heat treating the workpiece after its exit from one of the treatment chambers of the treatment stations.

15. The furnace of claim 1, further comprising rollers to convey the workpiece through the furnace, the rollers being located within the furnace and rotatably mounted using ceramic bearings.

16. The furnace of claim 15, wherein the rollers comprise metal tubes.

17. The system of claim 8, wherein the treatment chamber further includes rollers to convey the workpiece through the treatment chamber, the rollers being located within the treatment chamber and rotatably mounted using ceramic bearings.

18. The system of claim 17, wherein the rollers comprise metal tubes.

19. The furnace of claim 1, wherein the furnace temperature may be controlled within +/−5° C.

20. The system of claim 8, wherein the treatment chamber temperature may be controlled within +/−5° C.

21. A heat treatment furnace for heat treating a workpiece, the furnace comprising:

a treatment chamber into which the workpiece is introduced for heat treatment;

an electrically powered source of infrared radiation for heat treatment located within the chamber, the source having an electrical connection;

an enclosure outside the treatment chamber within which the electrical connection is located and substantially isolated from the treatment chamber;

a source of a first flowing gas in flow communication with the enclosure to flow gas past the electrical connection to cool the electrical connection, the first flowing gas being heated as it flows past the electrical connection; and a passage from the enclosure to the treatment chamber to exit the thus heated first flowing gas from the enclosure to the treatment chamber.

* * * * *